United States Patent [19]

Bernasconi

[11] 4,009,462

[45] Feb. 22, 1977

[54] EAST ACTUATING WATER RESISTOR

[75] Inventor: Felix Bernasconi, Zollikerberg, Switzerland

[73] Assignee: BBC Brown Boveri & Company Limited, Baden, Switzerland

[22] Filed: Nov. 25, 1975

[21] Appl. No.: 635,109

[30] Foreign Application Priority Data

Dec. 12, 1974 Switzerland ..... 16519/74

[52] U.S. Cl. ..... 338/80; 200/195; 323/99; 361/121

[51] Int. Cl.[2] ..... H01C 10/02

[58] Field of Search ..... 338/80–86, 338/222; 323/99; 317/16, 63, 64, 65; 200/185, 195, 235

[56] References Cited

UNITED STATES PATENTS

| | | | |
|---|---|---|---|
| 1,217,473 | 2/1917 | Mace | 338/86 |
| 1,258,050 | 3/1918 | Simmon | 338/86 X |
| 2,930,875 | 3/1960 | Waldvogel | 317/63 X |

FOREIGN PATENTS OR APPLICATIONS

| | | | |
|---|---|---|---|
| 1,063,698 | 8/1959 | Germany | 200/195 |

*Primary Examiner*—J. V. Truhe
*Assistant Examiner*—David A. Tone
*Attorney, Agent, or Firm*—Pierce, Scheffler & Parker

[57] ABSTRACT

A fast actuating water resistor of high power, especially for use in thermal power plants for transient assumption of loads in the event of a rapid reduction in load in the electrical system supplied by the plant or faults within the system includes a low-pressure steam boiler containing a pressurized hot highly conductive aqueous solution such as brine which is ejected from a ring-shaped nozzle producing an annular conical jet spray through a tubular electrode having a truncated conical configuration. The nozzle and electrode are located in a tank which also contains a grounded collecting grid on which the spray impinges after passing through the electrode which is electrically connected to a bus bar lead passing out of the tank to one of the phases of the electrical power system supplied by the plant. A small portion of the jet of hot solution is vaporized while travelling to the electrode to the collecting grid thereby to establish an electrical connection from the bus bar lead through the electrode to the collecting grid. A supplementary water distributor located in the tank above the tubular electrode and bus bar lead replaces the vaporized water and simultaneously sprays water having a low electrical conductivity onto the supports for these two components so as to wash off any deposits of the highly conductive brine solution which is sprayed in. A sump located at the bottom of the tank returns the fluid collecting in it by a pump to the inlet of the steam boiler through a non-return valve.

8 Claims, 1 Drawing Figure

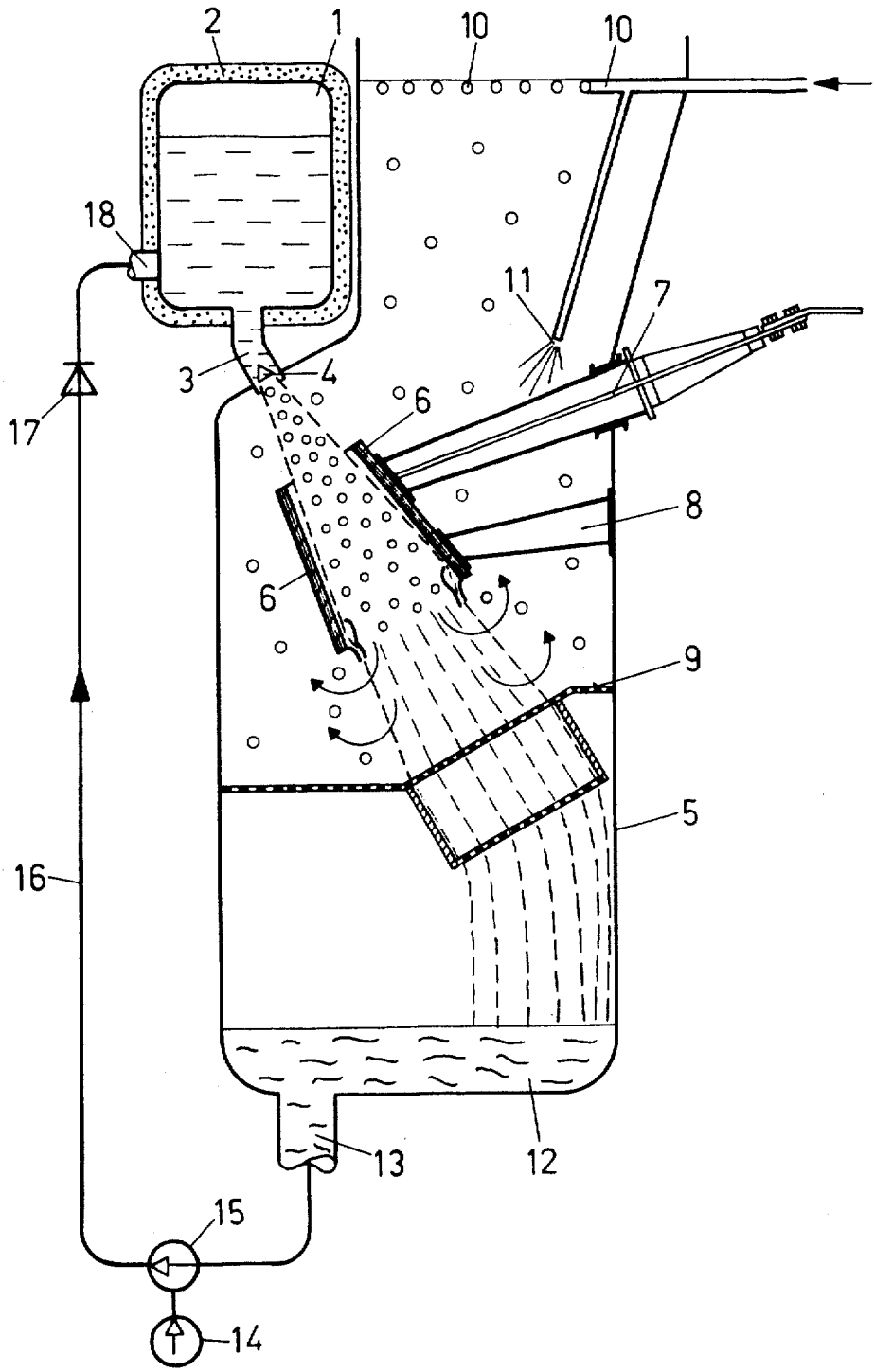
2
1
10
10
18
11
7
3
4
6
17
8
6
9
5
16
13
12
15
14

EAST ACTUATING WATER RESISTOR

This invention concerns a fast actuating water resistor of high power, especially for use in thermal power plants operated with fossil and also nuclear fuels, for the transient assumption of loads in the event of rapid reductions in load or faults within the external mains.

In the case of thermal power plants operating at magnitudes of 1,000 MW and above, especially in the case of nuclear power plants, some of the components are equipped with complex and costly devices to insure and improve rapid-action load adjustments.

Problems are caused by thermal stresses due to sudden changes in temperature involving thick-walled pressure chambers, pressure pipe lines, rotors and housings as well as by stability conditions involving the atomic reactor. One problem, frequently encountered in the construction of power plants of the above mentioned magnitude concerns mains stability and system faults.

Single- or three-phase switching operations can occur during the course of normal service, either to overcome short-circuits after multiple reconnection or to disconnect one or more phases, which require a rapid output control within time periods ranging from 0.1 to 1 seconds. If a reduction in load continues for longer time periods, the by-pass apparatus, comprising valves, coolers and pipe lines, will divert to the main condenser any excess steam not consumed any longer by the steam turbine.

Water resistors which are large-sized have been used in power plants for some time, primarily as constant load for inspection tests, as load substitute for hydro-electric power plants to eliminate tidal waves, for high-pressure hydro-electric power plants, and for the binary cycle of mercury vapor systems.

All known resistors comprise relatively voluminous units with plates or cones immersed in water. The power dissipation takes place by heating of the water since a water evaporation would lead to a considerable instability. In order to make certain that the water as the electrolyte will deliver a specific and defined load in case of a sudden switch-on, it becomes necessary to measure continuously the conductivity and to adjust the approximate depth of immersion prior to the circuit-closing. A rapid electrode adjustment for full load is not customary.

Also known are flow-type water resistors, which however do not permit an increase in the conductivity of the water, for example by the admixture of soda.

In use are also voluminous wire resistor systems, leading from three supporting towers (Electrical World, June 1, 1974).

The known arrangements are disadvantageous due to the fact that they are influenced by the salt content as well as by the standstill or operating temperature because of the great variation in electrolyte conductivity (flowing or cooling tower water). It becomes therefore necessary to adjust quickly and within wide limits the depth of plate immersion. An alternate solution is the step-wise connection or disconnection of the resistors. It is further necessary to maintain great distances between pole/pole/ground because of the danger of flash-over of the "boiling" water resistor system within the boiling water vapors. The variation in power output and the noise generated is quite excessive due to the formation of bubbles at the plates, the so-called seething.

It is the primary object of the invention to establish an arrangement which overcomes the above discussed disadvantages, while making possible a load assumption, in case of system faults, within approximately 0.2 seconds for a duration of up to one hour, and ensuring a rapid load restoring after reconnection of the power system, and which will avoid an undesirable sudden reduction in the generator load, for example in the event of valve failures.

The invention solves this problem in this manner that there are arranged within a tank for each phase of the system connected to the generator component of the thermal power plant one jet nozzle connected with a low-pressure steam boiler, one electrode- preferably a truncated cone electrode with bus-bar leads to the phase and insulated supports-, one collecting grid and one supplementary water distributor.

The arrangement of a jet nozzle, preferably a ring nozzle, at the outlet of a low-pressure steam boiler makes it possible to squirt a hot pressurized water jet, formed from a highly electrically conductive aqueous solution such as for example brine solution, into a truncated-cone electrode. From there the water jet will reach the collecting grid in the form of a multitude of narrow jets, whereby a fraction of the squirted water will vaporize. Approximately 60% of the vapor is generated between jet nozzle and truncated-cone electrode, and approximately 40% between the truncated-cone electrode and the collecting grid serving as ground electrode. Approximately half of the vapor volume escapes from the jet in the interior of the ring jet, whereby there arises a greater axial vapor velocity at the outlet of the truncated-cone electrode relative to the water velocity. The use of the supplementary water distributor makes it possible to cleanse the insulated supports continuously with supplementary water of low conductivity. This water, together with the not vaporized water, will collect in the pump sump and is used as water for the circulating system, possessing a specifically defined conductivity.

In a further, and preferred development of the invention the distance between the jet nozzle and the truncated-cone electrode, as well as the distance between the truncated-cone electrode and the collecting grid is dimensioned such as to accomplish a circuit-closing function within 0.1 to 0.2 seconds, and is further designed in such manner that during the circuit-breaking no arc will remain and that the water resistor is designed as a switching in-and-out device.

Furthermore, there is arranged between a pump sump in the tank and the low-pressure steam boiler a connecting pipe line with a circulation pump and a check valve, and the upper portion of the tank is designed as the steam outlet, with the pipes of the supplementary water distributor arranged therein.

Preferably, the jet nozzles, the collecting grid and the supplementary water distributor of the water resistance system are placed at ground potential.

A brine solution of high electrical conductivity is used for filling the steam boiler, while the supplementary water distributor carries treated water of low conductivity.

The water used for filling the low-pressure steam boiler is usually mixed with soda, thus forming a brine solution. However, the electrical conductivity of this solution requires continuous monitoring in order to attain maximum power when the water resistance is switched in to the circuit. In order to cleanse the insulative supports of brine splashes and to replace the vaporized water, supplementary water of the lowest possible conductivity is utilized. This supplementary water which enters the emerging vapor cloud and is preheated there, will then collect together with the not vaporized water in the pump sump, and is pumped from there to the low-pressure steam boiler by means of a motor-driven circulation pump. The low-pressure steam boiler does not require any further heating during operations.

A preferred embodiment of the invention is illustrated in the accompanying drawing in schematic form.

Numeral 1 denotes a low-pressure steam boiler which is covered by a thermal insulation 2 and is provided at its lower end with an outlet pipe 3 which accommodates a jet nozzle 4, preferably a ring nozzle. In the low-pressure steam boiler 1 there is present a highly conductive aqueous solution e.g. brine which is kept at boiling temperature and which is kept under suitable pressure. The outlet pipe 3 of the low-pressure steam boiler 1 leads into a tank 5 at a specifically set angle, preferably in such manner that the highly conductive jet is directed obliquely downward from the nozzle. Inside the tank 5 there is arranged a truncated-cone electrode 6 which is fastened to the inner wall of the tank 5 by means of insulated supports 8 and with bus-bar leads 7 extending from electrode 6 outwardly through the tank wall. Below the truncated-cone electrode 6, and at a certain distance from it, there is provided a collecting grid 9, serving as ground potential. Within the upper portion of the tank 5 there is arranged a grounded supplementary water distributor 10 in such manner that its outlet pipes 11 are directed at the bus-bar leads 7 and the insulated supports 8. In the bottom part of the tank 5 there is located a pumping sump 12 with an outlet pipe 13 which is connected, by way of a pump 15 driven by a motor 14, with a pipe line 16, containing an automatic check valve 17, said pipe line 16 leading to an inlet fitting 18 of the low-pressure steam boiler 1.

The above described water resistor operates as follows:

In the event of a system failure or phase swinging within the power mains the rapidly acting water resistor is cut in to the circuit by the opening of the jet nozzle 4. From the low-pressure steam boiler 1, which serves as storage for the quantity of electrically conductive water needed during the first few seconds prior to the start of the circulation pump, there is injected into and through the truncated-cone electrode 6 a water spray, heated to boiling temperature, by the jet nozzle 4 which is arranged within the outlet pipe 3. The truncated-cone electrode 6 is connected by the bus-bar leads 7 with one phase of the (not illustrated) current generator coupled to a steam turbine driven by the output from the boiler of the power plant. The jet nozzle 4, being designed in the form of a ring nozzle, will produce a conical annular jet the axis of which coincides with the conical electrode 6. The conductive water spray, after passing through electrode 6, upon hitting the collecting grid 9, which serves also as ground electrode, closes an electrical circuit between the bus-bar lead 7 and ground, the water spray will begin to vaporize, and the vaporization will spread within a very short period of time throughout the entire spray cone to the collecting grid 9. At the lower end of the truncated-cone electrode 6 the not vaporized conductive water is conducted in the form of individual jets to the collecting grid 9, and the vapor will emerge from the interior of the truncated-cone electrode 6 in the direction as indicated by arrow and flow upward for discharge through the upper part of tank 5. The not vaporized portion of the conductive water passes through the collecting grid 9 and then reaches the pump sump 12. In proportion to the vaporized volume, the supplementary water distributor, located in the upper part of tank 5, will spray treated water of lower conductivity from the pipe outlets 11 onto the insulated portion of the bus-bar leads 7 and the insulating supports 8, thus removing from there any electrolyte deposits. The supplementary water, which flows downward from the supplementary water distributor 10, is also pre-heated at this time by the uprising vapor cloud.

The water, after collecting in the pump sump 12, will flow through the exit opening 13 into the pipe line 16. In the meantime, pump 15 will start up and return the water, heated to boiling temperature, to the low-pressure steam boiler 1. Between the pump 15 and the inlet fitting 18 of the low-pressure steam boiler 1 there is arranged the automatic check valve 17 which will prevent the water present in the low-pressure steam boiler 1 from flowing back at the time when the pump 15 is not in operation.

The arrangement proposed by the invention attains a relatively high jet velocity (approximately 20 m/sec), resulting in a short cut-in time and a rapid adjustment speed. The high jet velocity makes feasible the use of a concentrated aqueous conductive solution. Also, the above described water resistor can connect and disconnect, due to the relatively great spray distance, magnitudes of 1,000 MW without the need for any additional switches.

I claim:

1. A fast actuating water resistor of high power, particularly useful in thermal power plants operated with fossil or nuclear fuels for transient assumption of loads in the event of a sudden reduction in load or faults with the mains which comprises, a low-pressure steam boiler containing a pressurized hot highly electrically conductive aqueous solution, a tank, a jet nozzle connected with an outlet from said boiler for spraying the hot pressurized solution into said tank, a tubular electrode, means insulatively supporting said electrode within said tank in spaced relation to said nozzle and in axial alignment with said nozzle, a bus bar lead extending from said electrode outwardly through said tank, means insulatively supporting said bus bar lead within said tank, a collecting grid located at the discharge end of said electrode and in spaced relation therefrom, said hot pressurized solution being vaporized upon passage through said electrode and to said collecting grid thereby to establish a resistive electrical connection from said bus bar lead through said electrode and vaporized solution to said collecting grid, and a supplementary water distributor located in said tank above the respective supporting means for said bus bar lead and electrode and to which washing water is delivered.

2. A fast actuating water resistor arrangement as defined in claim 1 wherein said jet nozzle has a ring-shaped configuration producing an annular conical jet spray and said tubular electrode has a truncated conical configuration co-axial with said ring-shaped nozzle and through which the annular conical spray is passed.

3. A fast actuating water resistor as defined in claim 2 wherein the spacing between said ring-shaped nozzle and the inlet end of said truncated conical electrode, and the spacing between the outlet end of the latter and said collecting grid is dimensioned for an electrical connection from said bus bar lead and electrode through the vaporized conductive aqueous solution to said grounded grid within a period of from 0.1 to 0.2 seconds, and disconnection is accomplished without any arc remainder.

4. A fast actuating water resistor as defined in claim 1 which further includes a pump sump at the bottom of said tank, a return pipe line from said sump to said low-pressure steam boiler, and a non-return valve located in said return pipe line.

5. A fast actuating water resistor as defined in claim 1 wherein the upper part of said tank functions as a steam outlet and wherein the distributing pipes of said water distributor are located in said upper part.

6. A fast actuating water resistor as defined in claim 1 wherein said collecting grid and supplementary water distributor are connected electrically to ground potential.

7. A fast actuating water resistor as defined in claim 1 wherein said electrically conductive aqueous solution in said boiler consists of brine.

8. A fast actuating water resistor as defined in claim 1 wherein the water supplied by said supplementary water distributor has a low electrical conductivity characteristic.

* * * * *